US011644238B2

(12) United States Patent
Martin et al.

(10) Patent No.: US 11,644,238 B2
(45) Date of Patent: May 9, 2023

(54) METHOD AND DEVICE FOR DRYING GYPSUM BOARD

(71) Applicant: Knauf Gips KG, Iphofen (DE)

(72) Inventors: Jürgen Martin, Kleinlangheim (DE); Gosbert Grebner, Albertshofen (DE)

(73) Assignee: Knauf Gips KG, Iphofen (DE)

( * ) Notice: Subject to any disclaimer, the term of this patent is extended or adjusted under 35 U.S.C. 154(b) by 0 days.

(21) Appl. No.: 16/955,985

(22) PCT Filed: Dec. 21, 2017

(86) PCT No.: PCT/EP2017/001436
§ 371 (c)(1),
(2) Date: Jun. 19, 2020

(87) PCT Pub. No.: WO2019/120462
PCT Pub. Date: Jun. 27, 2019

(65) Prior Publication Data
US 2020/0318903 A1 Oct. 8, 2020

(51) Int. Cl.
*F26B 15/12* (2006.01)
*F26B 3/04* (2006.01)
(Continued)

(52) U.S. Cl.
CPC ..... *F26B 15/12* (2013.01); *F26B 3/04* (2013.01); *F26B 21/022* (2013.01); *F26B 23/002* (2013.01)

(58) Field of Classification Search
CPC ..... F26B 5/045; F26B 5/047; F26B 2210/14; F26B 2210/16; F26B 15/12; F26B 3/04; F26B 23/002; Y02P 70/10
(Continued)

(56) References Cited

U.S. PATENT DOCUMENTS 5,659,975 A * 8/1997 Bahner ..... F26B 15/12 34/459
6,837,706 B2 1/2005 Straetmans et al.
(Continued)

FOREIGN PATENT DOCUMENTS

CN 102735043 A 10/2012
DE 202009017286 U1 6/2010
(Continued)

*Primary Examiner* — John P Mccormack
(74) *Attorney, Agent, or Firm* — The Webb Law Firm

(57) ABSTRACT

A device for drying sheets includes:
- a conveying device for conveying sheets through the device for drying sheets,
- a first drying stage arranged towards an upstream end of the device for drying sheets and comprising at least one drying chamber,
- first stage drying air supply means for introducing hot air into said at least one drying chamber of said first drying stage at a drying air inlet;
- air discharge means for discharging exhaust air from said at least one drying chamber of said first drying stage,
- a second drying stage arranged downstream of the first drying stage and comprising at least one drying chamber;
- transfer means for transferring exhaust air discharged from said at least one drying chamber of the first drying stage into said at least one drying chamber of the second drying stage;
- humid drying air supply means for introducing said exhaust air into said at least one drying chamber of said second drying stage, said humid drying air supply means comprising at an humid drying air inlet for introducing humid drying air arranged at an upstream position of the second drying stage;
- supplemental air supply means for introducing supplemental air into said second drying stage at an supplemental air inlet arranged downstream of said humid drying air inlet.

(Continued)

A method for drying sheets is also disclosed.

11 Claims, 2 Drawing Sheets

(51) Int. Cl.
*F26B 21/02* (2006.01)
*F26B 23/00* (2006.01)

(58) Field of Classification Search
USPC ..... 34/495, 236
See application file for complete search history.

(56) References Cited

U.S. PATENT DOCUMENTS

| | | | | |
|---|---|---|---|---|
| 2010/0299956 | A1* | 12/2010 | O'Brien | F26B 23/10 34/500 |
| 2011/0023314 | A1 | 2/2011 | Schwerer et al. | |
| 2012/0246966 | A1 | 10/2012 | Straetmans et al. | |
| 2015/0198368 | A1* | 7/2015 | Schmit | F26B 23/002 34/88 |
| 2015/0308739 | A1 | 10/2015 | Mongrolle et al. | |
| 2017/0002515 | A1* | 1/2017 | Saikkonen | D21F 5/20 |

FOREIGN PATENT DOCUMENTS

| | | | |
|---|---|---|---|
| JP | 382190 | D | 3/1963 |
| JP | 8512399 | A | 12/1996 |
| JP | 2013515229 | A | 5/2013 |
| WO | 9504908 | A1 | 2/1995 |
| WO | 2011076180 | A1 | 6/2011 |

* cited by examiner

METHOD AND DEVICE FOR DRYING GYPSUM BOARD

CROSS-REFERENCE TO RELATED APPLICATIONS

This application is the United States national phase of International Application No. PCT/EP2017/001436 filed Dec. 21, 2017, the disclosure of which is hereby incorporated by reference in its entirety.

BACKGROUND OF THE INVENTION

Field of the Invention

The invention pertains to a device for drying sheets, in particular gypsum building boards, especially gypsum plasterboards, and to a method for drying sheets, in particular gypsum building boards, especially gypsum plasterboards.

Description of Related Art

Gypsum is capable of being dehydrated to form stucco (calcium sulfate hemihydrate) which subsequently can be rehydrated and cast, molded or otherwise formed to useful shapes, such as boards. Gypsum is generally prepared for use as a stucco by grinding and calcining at relatively low temperatures from about 120 to 170° C., generally at atmospheric pressure.

In the production of gypsum plasterboards calcium sulfate hemihydrate (stucco) is mixed with water and optionally further additives to provide a viscous slurry. The slurry is then cast onto a liner, e.g. a paper layer, to obtain a gypsum slurry layers of particular thicknesses. The uppermost gypsum slurry layer is then covered with a further liner. The sandwich of the two liners with gypsum slurry layers between then passes a pair of forming plates and/or rolls in order to form the board. The structure passes along a conveyor line to allow the stucco to rehydrate and harden. During curing the water reacts with the stucco to obtain calcium sulfate dihydrate thereby curing the gypsum by recrystallization. The cured structure is cut to provide multiple boards of the desired length and these are then transferred to a drying system to allow for excess water to be evaporated.

To allow handling of the viscous gypsum slurry, sufficient water has to be added to the stucco to adjust viscosity such that the slurry can be pumped and cast onto the liner. On the liner, the slurry has to be sufficiently flowable to homogeneously distribute over the entire liner breadth. Therefore, the stucco slurry has to contain water in a hyperstochiometric amount. The amount of water added to the stucco is in excess of the stoichiometric amount of water required for setting of the gypsum. Excess water remains in the gypsum layer after setting and said water has to be removed by evaporation.

The performance of a gypsum plasterboard is determined by the performance of the gypsum layers and of the liners attached on opposite sides of the gypsum layer structure. Whereas the gypsum layers impart stiffness and impact stability to the board, the liners impart flexural strength to the gypsum plasterboard. It therefore is important to provide sufficient adhesive strength between the gypsum layer and the liners.

Gypsum plasterboards are usually produced in a continuous manner in production lines. As described above, in a first stage gypsum slurry is cast on a liner and then a further liner is placed on top of the topmost wet gypsum layer. After the gypsum layer has gained sufficient stability by curing, the composite is cut to boards of a desired size. The boards are then transported to a drying device for removal of excessive water. Removal of excessive water is usually done by contacting the wet board with hot air. The hot air passes along the surface of the board to absorb water vapor. The gypsum plaster board is dried and concurrently the air is cooled due to the evaporation of water. Also gypsum fiber boards have to be dried in drying devices to evaporate the excess-water. Thus, in the following the term "gypsum board" is meant to comprise "gypsum plasterboards" and "gypsum fibre boards" or other "gypsum building boards" unless otherwise stated.

Since drying consumes high amounts of energy, the amount of excessive water comprised in the gypsum slurry is tried to be kept as low as possible. As a further measure to reduce the energy consumption, it is tried to use the heat for drying efficiently, e.g. by recirculating air used for drying. The air is then repeatedly contacted with the wet boards and is reheated after each contact. The air is increasingly enriched with moisture. Part of the circulated humid drying air is separated and discharged to remove excess moisture from the system. Heat comprised in the wet exhaust air can be recovered e.g. in a heat exchanger to heat fresh air.

The heat supply along a longitudinal direction of the drying device is designed corresponding to the amount of excessive water comprised in the gypsum board. Gypsum boards have a thickness in a range of about 6 to 60 mm. Due to heat released by the setting procedure the gypsum board has a temperature of about 25 to 45° C. when entering the drying device. The board is then homogeneously heated to a temperature of approx. 80 to 110° C., preferably to about 90 to 100° C. to accelerate drying. In the beginning of the drying process the gypsum board comprises large amounts of water. High amounts of heat therefore can be supplied to the wet gypsum board to accelerate drying without the danger of calcination of the outermost layers of the gypsum board, wherein calcium sulfate dihydrate is accidentally dehydrated to calcium sulfate hemihydrate. During a first stage of the drying process hot air generally having a temperature of more than 200° C. therefore can be used at a high mass flow. Due to evaporation of water the gypsum board is cooled and the temperature of the gypsum stays below about 100° C. even in the zone bordering the liners encasing the gypsum layers. Adhesion between the gypsum layers and the liners attached thereto is therefore ensured.

The adhesion of the liners to the gypsum layer is at least partially due to the growth of calcium sulfate dihydrate crystals into the liner material. To prevent deterioration of the adhesion between gypsum and liner, heating of the gypsum layer to a temperature exceeding about 100° C. has to be avoided. If temperatures at the interface gypsum/liner of gypsum plasterboards rise above this threshold the calcium sulfate dihydrate is converted to the hemihydrate with a loss of the crystal structure and therefore also a loss of adhesion between the gypsum and the liner.

In a later stage of the drying process the amount of water still comprised in the gypsum layers becomes lower and, therefore, also the cooling effect due to evaporation of water diminishes. Further, the amount of excessive water comprised in the center part of the board is higher than in those parts adjacent to the liners provided on the outside of the gypsum board.

Towards end of the drying process, when the gypsum board comprises only low amounts of surplus water, the heat supply has to be lowered to avoid excessive heating of the outermost gypsum layers with formation of calcium sulfate hemihydrate.

At the end of the drying process the temperature of the air used for drying is further lowered such that the dry gypsum boards can be removed from the drying device.

Exhaust air accumulating during the drying process still comprises high amounts of energy that is recycled in the process to increase efficiency. The heat can be regained for example in a heat exchanger wherein exhaust air is conducted in counter flow to the fresh cold air such that the exhaust air is cooled and the fresh air is warmed up. When the exhaust air is cooled below its dew point also the heat of condensation can be used for warming up fresh air.

As an alternative, the exhaust air can be re-used directly in the drying process. This can be done for example by mixing the exhaust air with fresh air and using the mix as inlet air of a drying section.

Since in an early stage of the drying process air having a high temperature is used, the exhaust air still has sufficient drying capacity to be used as drying medium in a later stage of the drying procedure. The humidity comprised in the drying air increases the heat capacity of the air so that humid air can be used very efficiently for drying of the gypsum boards as long as the air has sufficient capacity for further moisture uptake.

However, as already discussed, towards end of the drying process the temperature of the drying air has to be lowered to avoid excessive heating of the gypsum with transformation of calcium sulfate dihydrate to calcium sulfate hemihydrate.

When reducing the temperature of the drying air care has to be taken not to fall below the dew point. Below the dew point condensation of water vapor results in the formation of liquid water. Condensed water can deteriorate quality of the gypsum boards and in particular may cause corrosion of the drying device.

Therefore, in drying devices of the state of the art only part of the exhaust air accumulating in early stages of the drying process is used directly in a later stage of the drying process and the remaining part is e.g. fed to a heat exchanger for the warming up of fresh air.

Setting and drying of gypsum boards is performed continuously. Thus, production lines for gypsum boards are quite long, and often have a length of several hundred meters. Such production lines therefore have quite high spatial requirements.

In US 2012/0246966 A1 a method and device for drying sheets is described. The sheets are guided through a drier divided into drying chambers and brought in contact with the drying air by means of impinging jet aeration. The impinging-jet aeration utilizes cross-aerated nozzle boxes. The drying stage is split into a main drying stage and a final drying stage. The exhaust air of the individual drying chambers of the main stage is collected and introduced into the final drying stage. In practice, the main drying stage exhaust air is introduced in the pressure chamber of one or more drying chambers in the first half of the final drying stage. Part of the recirculated exhaust air is used for drying in the drying chamber and another part is introduced into the suction chamber of the respective subsequent drying chamber. The exhaust air from the one or more drying chambers in the second half of said final drying stage is extracted at a significantly lower temperature.

U.S. Pat. No. 6,837,706 B2 describes a drying unit for gypsum plasterboards with a feed device comprising several roller feed units arranged in levels one above the other. The drying section is generally divided into several zones, in particular three longitudinally ventilated zones: two high temperature zones and a subsequent low temperature zone. Due to the high production capacity of the upstream production plant and the long residence time, drying units are very long. Black boards are arranged above and below the individual roller feed units in the high temperature zones, which extend across the width of the roller feed units. The black boards are heated exclusively by means of the flowing drying air and transmit additional heat to gypsum plasterboard by radiation. Due to the increased heat transfer coefficient it is possible to reduce the length of the drying unit.

In U.S. Pat. No. 5,659,975 is described a board drying process and a drier. In order to dry boards, the boards are guided on racks through a drier and are brought into contact with drying air in two stages. In a stage A with a higher drying power, the drying air is supplied at a higher temperature and with an at least average humidity, and in the other stage B, it is supplied at an average temperature and with a low humidity. The outgoing air from stage A is supplied to stage B through a heat exchanger arranged in the rack of the drier. The drying air of stage B is supplied in counter-current through the drier with a low humidity and temperature, so that the boards are dried in stage B both by condensation heat and by radiant heat. Thus only a reduced mass flow of drying air is required to transfer the condensation heat. The consumption of primary and secondary energy is low.

US 2015/0308739 A1 describes a drying system for drying boards wherein a board is conveyed through a drying device along a longitudinal direction. Rollers are provided for supporting the board in a support plane containing the longitudinal direction of the drier. Air inflow means are provided for directing airflow towards the faces of the board. The air inflow means comprise a lower and an upper conduit extending transversely to the longitudinal direction of the drier. Lower and upper conduits have a plurality of apertures for directing airflow towards an underside and a upper side of the board, respectively. The air introduced through the apertures is aligned with the longitudinal axis of the drier. Thereby the contact time between the air and the underlying boards and thus the drying rates are increased. By providing larger conduits, relative to the space available between adjacent rollers, the size of the gaps between the conduits and the boards may be decreased and/or the size of the surface of the conduit that is opposed to the respective face of the board may be increased, thus assisting in channeling airflow in a longitudinal direction of the drier.

The annual production of gypsum plasterboards can amount to several million square meters per production site. The energy required for drying of wet gypsum plasterboards therefore is quite high and there is a continuous need for further reduction of energy requirements in gypsum plaster production. Further, the establishment of a new production line requires considerable financial investments.

Therefore, the object of the claimed invention is to provide a device for drying sheets, in particular gypsum plasterboards, as well as a method for drying sheets, in particular gypsum plasterboards, that has a high drying efficiency at low energy consumption, and wherein the device preferably has low investment costs and smaller spatial requirements than production lines known from the state of the art.

SUMMARY OF THE INVENTION

These objects are solved by a device for drying sheets according to invention and a method for drying sheets according to the invention.

According to a first aspect of the invention a device for drying sheets is provided, comprising:

- a conveying device for conveying sheets through the device for drying sheets,
- a first drying stage arranged towards an upstream end of the device for drying sheets and comprising at least one drying chamber,
- first stage drying air supply means for introducing hot air into said at least one drying chamber of said first drying stage with at least one a drying air inlet;
- air discharge means for discharging exhaust air from said at least one drying chamber of said first drying stage,
- a second drying stage arranged downstream of the first drying stage and comprising at least one drying chamber;
- transfer means for transferring exhaust air discharged from said at least one drying chamber of the first drying stage into said at least one drying chamber of the second drying stage;
- humid drying air supply means for introducing said exhaust air into said at least one drying chamber of said second drying stage, said humid drying air supply means comprising at least one humid drying air inlet for introducing humid drying air at an upstream position of the second drying stage;
- supplemental air supply means for introducing supplemental air into said second drying stage via at least one supplemental air inlet arranged downstream of said humid drying air inlet.

In the device for drying sheets according to the invention exhaust gases discharged from the first drying stage and still having a quite high temperature are introduced into the second drying stage to be used for further drying of the sheets. The humidity contained in these exhaust gases is due to evaporation of water from the sheets in the first drying stage. Higher humidity of the drying air results in a higher drying efficiency.

In the device for drying sheets according to the invention supplemental air supply means are provided for introducing supplemental air into the second drying stage via at least one supplemental air inlet arranged downstream of the humid drying air inlet. The supplemental air is mixed with the humid drying air comprising exhaust air transferred from the first drying stage and introduced into the second drying stage at an upstream position of the second drying stage and then travelling downstream. In the upstream part of the second drying stage the humid drying air takes up further moisture from the sheets, in particular gypsum boards, pre-dried in the first drying stage and travelling through the second drying stage. The moisture uptake of the humid drying air at the same time cools the humid drying air, resulting in its dew point rising. To avoid excessive heating of the sheets the drying temperature, which is equivalent to the temperature of the humid drying air, has to be lowered towards a downstream end of the second drying stage while the sheets travel in a downstream direction in the second drying stage. The amount of humidity comprised in the sheet decreases and, therefore, also the cooling effect imposed on the sheets by evaporation of water decreases. The temperature of the air and the temperature of the sheets travelling through the second drying stage therefore converge. To avoid calcination of calcium sulfate dihydrate with formation of calcium sulfate hemihydrate or anhydrite, the temperature of the sheets has to be kept below a threshold value. When drying gypsum boards, the temperature has to be kept below about 100° C. to avoid calcination. By addition of supplemental air to the humid drying air flow at a downstream position of the second drying stage it is possible to lower the dew point of the humid drying air and to cool the humid drying air, if required, by appropriate selection of the temperature of the supplemental air. Condensation of liquid water and excessive heating of the sheets therefore is avoided.

Preferably, the supplemental air inlet is arranged at a position downstream of at least 30%, preferably of at least 40% of the total length of the second drying stage.

Since the temperature and the dew point of the humid drying air can be adjusted at a downstream position of the second drying stage by addition of supplemental air, it is possible to use a high mass flow, preferably all of the exhaust air from the first drying stage. The exhaust air has a high energy content due to high temperature and/or high moisture content which can be recycled without the danger of condensation of water towards end of the second drying stage or the danger of excessive heating of the gypsum board at an advanced phase of the drying procedure which could initiate a transformation of calcium sulfate dihydrate into calcium sulfate hemihydrate. The temperature of the supplemental air can be adjusted accordingly to cool the humid drying air containing the exhaust air from the first stage to a level avoiding transformation of the calcium dihydrate into the hemi hydrate and to lower the dew point of the drying medium (by diluting it with dry supplemental air) sufficiently to avoid condensation of water.

A hot air is understood to be air introduced into a drying chamber of the first drying stage for drying sheets in the first drying stage.

An exhaust air discharged from the first drying stage is understood to be at least a part of the drying air accumulating during drying of the sheets, in particular gypsum boards, in the first drying stage and discharged from the first drying stage. The exhaust air discharged from the first drying stage can be formed by exhaust air discharged from one or more drying chambers forming the first drying stage or forming part of the first drying stage. In particular in an embodiment wherein the first drying stage comprises more than one drying chamber, the drying chambers can be run at different temperatures. The exhaust air taken from the first drying stage may then according to an embodiment be formed by only part of the exhaust gas taken from particular drying chambers, e.g. from drying chambers where the sheets are dried at a higher temperature than in other drying chambers of the first drying stage. According to another embodiment, the exhaust air discharged from the first drying stage is formed by the combined exhaust air taken from all drying chambers of the first drying stage.

A humid drying air is understood to be air used in the second drying stage for drying sheets, in particular gypsum boards. The humid drying air is at least in part formed by exhaust gas discharged from the first drying stage. The humid drying air contains moisture collected in the first drying stage. The humid drying air can be formed totally from exhaust gas discharged from the first drying stage or may additionally contain air from other sources. When entering the second drying stage, the humid drying air may have the temperature provided by the exhaust air discharged from the first drying stage or may have a higher temperature e.g. by heating the exhaust air from the first drying stage in a heating device.

A supplemental air is understood to be (external) air that contains less water than the humid drying air introduced into the second drying stage.

The sheets, in particular gypsum boards, are conveyed through the device for drying sheets according to the invention. Conveying of the sheets occurs in a longitudinal direction. A longitudinal direction is understood to be a direction corresponding to the direction of travel of the sheets through the device for drying sheets. The device for drying sheets generally has its largest extension in the longitudinal direction wherein the sheets are fed to the device for drying sheets at one end of the device and the sheets exit the device at an opposite end.

A transversal or crosswise direction is understood to be a direction orthogonal to the longitudinal direction and parallel to the plane of the sheets.

A vertical direction is understood to be a direction orthogonal to the longitudinal direction and orthogonal to the plane of the sheets.

A plane of the sheets is understood to be a plane of the sheets having the largest extension. The thickness of a sheet is an extension of the sheet in a direction orthogonal to the plane of the sheets. The sheets have an even form with plane surfaces on opposite sides of the sheet.

The sheets enter the device for drying sheets at one end of the device for drying sheets and leave the device at an opposite end. "Upstream" is understood to be a location in the device for drying sheets arranged closer to that end of the device where the sheets enter the device for drying sheets. "Downstream" is understood to be a location in the device for drying sheets arranged closer to the end of the device where the sheets leave the device for drying sheets.

The device for drying sheets comprises a conveying device for conveying sheets through the device for drying sheets. Conveying devices known from the state of the art can be used. Exemplary conveying devices are band conveyors or roller conveyors. The conveying device allows continuous transportation of the sheets through the device for drying sheets.

The conveying device transports sheets, in particular gypsum boards, through the drying device in a longitudinal direction from an upstream end of the drying device to a downstream end of the drying device. At an upstream end of the drying device sheets are transferred from a sheet-making device, in particular a device for forming gypsum boards, into the drying device. In such a sheet-making device the sheets are formed and, according to an embodiment, cut to a particular size. The sheet-making device and the device for drying sheets can both form production units in a continuous production line for making for example gypsum boards.

The conveying device can be designed to transport sheets one after the other through the drying device in a single deck. According to an embodiment, the conveying device comprises several decks arranged one on top of each other. The sheets then can be conveyed through the drying device concurrently in several decks.

The capacity of the sheet-making device usually is quite high. Since drying of the sheets requires time to reach the desired humidity level in the sheets, use of a dryer comprising several decks allows to increase the capacity of the dryer at limited space requirements and to adjust the capacity of the dryer to the capacity of the sheet making device.

According to an embodiment, the number of decks comprised by the dryer is selected within a range of 4 to 16, according to a further embodiment within a range of 8 to 12.

According to an embodiment, each deck is provided with a conveying device for continuously transporting the sheets through the drying device.

The width of the conveying device is selected to allow transportation of sheets through the drying chambers of first and second drying stage. According to an embodiment the width of the conveying device is selected within a range of 2 to 6 meters, according to a further embodiment of 3 to 5 meters. The width of the conveying device refers to the width of the means used for transporting the sheets, e.g. the width of a band travelling through the drying device or the width of a roller used for transporting the sheets. Several sheets then can be arranged side by side in a transversal direction of the conveying device to be conveyed through the drying device.

A first drying stage is arranged towards an upstream end of the device for drying sheets and is comprising at least one first-stage drying chamber.

The sheets enter the drying device by entering the at least one first-stage drying chamber at an upstream end of the first drying stage.

According to an embodiment, means for pre-heating the sheets can be provided upstream of the first drying stage. The sheets are received from the sheet-making device and have to be heated to initiate evaporation of water. A separate device for pre-heating sheets can be provided upstream of the first drying chamber of the first drying stage. Of course the device for pre-heating the sheets can also be integrated into the device for drying sheets.

The sheets, in particular the gypsum boards, are conveyed in a longitudinal direction through the first drying stage by the conveying means. In the first drying stage part of the water contained in the sheets is removed. For removal of the water, heat is applied to the sheets. According to an embodiment, the heat is applied by hot air flowing along the surface of the sheets thereby absorbing moisture.

First stage hot air supply means for introducing hot air into the at least one drying chamber of the first drying stage and air discharge means for discharging exhaust air from said at least one drying chamber of the first drying stage are provided. As first stage hot air inlet, means for introducing hot air as known from the state of the art can be used. According to an embodiment, nozzles are provided to direct the hot air flow onto the surface of the sheets.

According to an embodiment, hot air inlets are provided above and below the transport plane of the sheets in the at least one drying chamber of the first drying stage. By blowing hot air on both surfaces of the sheet, in particular gypsum board, drying rates can be increased and a homogeneous progress in drying of the sheet can be achieved thereby avoiding formation of cracks or development of an uneven surface in the sheet.

According to an embodiment, hot air inlets for introducing hot air are situated at an upstream end of the first drying stage of the device for drying sheets, in particular at an upstream end of a first drying chamber of the first drying stage, close to the entry of the sheets into the at least one drying chamber of the first drying stage of the device for drying sheets. The hot air then travels along the surface of the sheets in a longitudinal direction parallel to the transport direction of the sheets through the device for drying sheets.

The hot air can be introduced at only one location into the first drying stage through first hot air inlets. However, according to an embodiment it is also possible to place further hot air inlets for introducing hot air into the first drying stage at places downstream of the first hot air inlets.

According to an embodiment, the hot air inlets can be located at an intermediate position between both lateral sides of the converging means or at one or both lateral sides of the conveying means. According to an embodiment, the airflow can be introduced in a direction parallel to the longitudinal direction. The airflow can have the same or opposite direction relative to the transport direction of the sheets.

For preparation of hot air, an air heating device can be provided in the first stage drying air supply means. Air heating devices known from the state of the art can be used to heat the air. The air is guided to the air heating device by air supply means. Exemplary air heating devices are heat exchangers in which air is moved counter currently to a heating medium and thereby is heated. Such heating medium can be for example exhaust air having a high load of water vapor. According to another embodiment, at least one burner is provided in the first stage drying air supply means and the air is heated by burning fuel or natural gas. The hot air then is introduced into the at least one drying chamber of the first drying stage at a drying air inlet.

Further, exhaust air discharge means for discharging exhaust air from said at least one drying chamber of said first drying stage are provided. After moisture uptake from the sheets the hot air is discharged from the at least one drying chamber of the first drying stage in the form of exhaust air. Since the discharged exhaust air has a high temperature and might have further capacity for water uptake, the discharged exhaust air can be reused for (further) drying of the sheets.

According to an embodiment, part of the exhaust air discharged after having travelled along the sheets and after take-up of moisture from the sheets is recirculated and reintroduced into the first drying stage, e.g. at an upstream position as recirculated air.

Splitting means are provided according to an embodiment for splitting the flow of exhaust air discharged from the at least one first stage drying chamber into an exhaust part forming the exhaust air and a recirculated part to be reintroduced into the first drying stage in the form of recirculated air.

According to an embodiment, the splitting means are adjustable to adjust the exhaust part and the recirculated part of the exhaust air discharged from at least one drying chamber of the first drying stage. Preferably, all of the exhaust air is recirculated.

According to an embodiment, a recirculation pipe is provided. The recirculation pipe is connected to the splitting means for receiving the recirculated part of the exhaust air discharged from the at least one drying chamber of the first drying stage. The recirculation pipe is further connected to the at least one drying chamber of the first drying stage for reintroducing the recirculated air through the hot air inlet.

Heating means, e.g. a burner, can be provided in the recirculation pipe to reheat the recirculated air before reintroduction into the first drying stage. Furthermore, driving means can be provided in the recirculation pipe, e.g. a fan or a compressor, for driving the recirculated air through the recirculation pipe.

The exhaust air discharged from the at least one drying chamber of the first drying stage is collected and at least partly transferred to the second drying stage by transfer means 120 for transferring exhaust air discharged from said at least one drying chamber of the first drying stage into at least one drying chamber of the second drying stage. The exhaust air can be mixed with other air, e.g. air recirculated within the second drying stage and forms humid drying air that is used as drying medium in the second drying stage. The humid drying air is then introduced into the second drying stage at an humid drying air inlet arranged at an upstream position of the second drying stage.

According to an embodiment, the humid drying air comprises exhaust air collected from the first drying stage which is then directly introduced into the second drying stage. The transfer means 120 then can be formed by a simple tube transferring the exhaust gas from the first drying stage into the second drying stage.

According to a further embodiment, a bypass is provided between the last first-stage drying chamber arranged at a downstream end of the first drying stage and the first second-stage drying chamber arranged at an upstream end of the second drying stage. The bypass can be e.g. an opening used for transferring the sheets between the drying chambers. The exhaust air of the first drying stage then can enter the second stage directly by flowing from the first-stage drying chamber to the second-stage drying chamber.

Suction means can be provided to assist the transfer of exhaust air from the last first-stage drying chamber arranged at a downstream end of the first drying stage into the second drying stage.

According to a still further embodiment, the exhaust air collected from the first drying stage can be heated to a higher temperature before being introduced into the second drying stage. Accordingly a heater, e.g. a burner, is provided in the transfer line and the exhaust air discharged from said at least one drying chamber of the first drying stage is heated before entering the a second drying stage at a humid drying air inlet. The humid drying air inlet is arranged at an upstream position of the second drying stage.

A second drying stage comprising at least one drying chamber is arranged downstream of the first drying stage.

The second drying stage can have a design similar to the first drying stage or can have a design different from the design of the first drying stage.

The first drying stage of the drying device is formed by drying chambers in which exhaust air is collected. The second drying stage is formed by drying chambers in which the exhaust air collected in the first drying stage is used for drying sheets pre-dried in the first drying stage.

At an upstream end of the second drying stage, sheets that have been partly dried in the first drying stage are introduced and conveyed in a longitudinal direction through the second drying stage while being further dried and exit at an downstream end of the second drying stage opposite to the upstream end.

The sheets, in particular gypsum boards, are conveyed through the second drying stage by the conveying means. The conveying means are preferably designed such that an continuous transfer of the sheets from the first drying stage to the second drying stage is achieved.

In the second drying stage the partly dried sheets, in particular gypsum boards, are dried further to remove residual moisture still comprised in the sheets after passage of the first drying stage. Since the amount of water still comprised in the sheets becomes lower, in particular towards end of the drying procedure, care has to be taken not to excessively heat the sheets. Towards end of the second drying stage, the sheets can be cooled before exiting the second drying stage.

At least one humid drying air inlet is provided in the second drying stage for introducing humid drying air comprising exhaust air discharged in the first drying stage.

The humid drying air inlet is placed at an upstream position of the at least one drying chamber of the second drying stage.

Second-stage discharge means are provided in the at least one drying chamber of the second drying stage for discharging humid drying air after passage of the at least one drying chamber of the second drying stage.

According to an embodiment, humid drying air inlet and second-stage discharge means are provided at or close to opposite ends of the at least one drying chamber. According to embodiments, humid drying air inlet and second-stage discharge means can be arranged at an upstream and a downstream end of the at least one drying chamber to establish a longitudinal airflow of humid drying air or can be arranged laterally of the transport direction to establish a crosswise flow of the humid drying air.

According to the invention, supplemental air supply means 140 for introducing supplemental air into said second drying stage at an supplemental air inlet arranged downstream of said humid drying air inlet are provided.

As already explained above, towards the end of the drying process the amount of free water comprised in the sheets, in particular gypsum boards, becomes low and cooling efficiency caused by evaporation of water is lowered. Further, the amount of free water comprised in the core of the sheet, in particular gypsum board, is higher than at or close to the surfaces of the sheet. For evaporation, the water has to diffuse from the core of the sheet towards the surface of the sheet to then be evaporated. In particular in gypsum plaster boards, the water also has to pass a liner when provided on the outer surfaces of the outermost gypsum layer.

By providing supplemental air supply means downstream of the humid drying air inlet it is possible to adjust the temperature profile and the humidity profile of the drying air in the longitudinal direction of the second drying stage. High temperatures at relatively high humidity levels can be used in the earlier stages of the second drying stage thereby increasing efficiency of the drying procedure. By introducing supplemental air the dew point of the humid drying air is lowered and the temperature of the humid drying air can be lowered without initiating condensation of liquid water. The temperature and the humidity of the supplemental air can be adjusted accordingly.

According to an embodiment, a heater for heating the supplemental air is provided in the second drying stage. The heater can be according to an embodiment a heat exchanger using heat generated at another stage of the process, or can be a burner according to another embodiment. The burner can use fuel to prepare the supplemental air.

The heater can be provided in a supply line for introducing supplemental air into the second drying stage. In the supply line fresh air or external air can be supplied to the heater to obtain supplemental air. The supplemental air is then supplied to the second drying stage.

The supplemental air can be supplied to a drying chamber of the second drying stage directly.

According to another embodiment, a second-stage recirculation line is provided to recirculate humid drying air within the second drying stage, preferably to the last drying chambers. During a passage through a second-stage drying chamber the capacity for adsorption of moisture by the humid drying air is not used completely. Therefore at least part of the humid drying air can be recirculated and enter the second stage drying chambers again.

According to an embodiment a burner is provided in the second-stage recirculation line. The burner heats the recirculated humid drying air before the humid drying air enters the second-stage drying chamber again.

According to a further embodiment, means for accelerating the humid drying air flow in the second-stage recirculation line, e.g. a fan or a compressor, can be provided in the second-stage recirculation line.

For removal of moisture from the drying device, a second-stage splitter can be provided in the second-stage recirculation line and part of the humid drying air flowing in the second-stage recirculation line is recirculated to the drying chamber, and another part of the humid drying air is removed from the drying device.

For re-use of heat comprised in the humid drying air removed from the drying device a heat exchanger can be provided in a discharge line for discharging the humid drying air removed from the drying device.

According to an embodiment, the supplemental air inlet is provided in the second-stage recirculation line. The supplemental air is then intensely mixed with the humid drying air before re-entering the second-stage drying chamber and contacting the sheets. A homogeneous drying of the sheets is thereby achieved.

According to a further embodiment, the supplemental air inlet provided in the second-stage recirculation line is located downstream of a heating device for heating the recirculated humid drying air, in particular a burner.

According to an embodiment, the second drying stage comprises more than one drying chamber. The sheets then travel sequentially through the drying chambers, which are arranged one after the other. Openings are provided in walls of the second stage drying chambers that allow transfer of the sheets from one drying chamber to a neighboring drying chamber. Preferably, the size of the openings is selected such that only limited amounts of humid drying air used in a particular drying chamber for drying are transferred to the neighboring drying chamber, and a humid drying air exchange between neighboring drying chambers is kept at a minimum.

The direction of the airflow in the drying chambers of the first and second drying stage can be selected either longitudinal or crosswise. The direction of air flow can be the same or can be different from the drying chambers of the first and second drying stage.

A longitudinal airflow is understood to be an airflow in a longitudinal direction of the device for drying sheets. The airflow can be in a direction of the transport direction of the sheets or can be opposite to the direction of transport of the sheets. For a longitudinal airflow, air supply means and air discharge means are placed according to an embodiment at or close to opposite ends of the drying chamber in a longitudinal direction. In an embodiment wherein the first and/or the second drying stage comprises more than one drying chamber, the direction of the longitudinal airflow can be selected individually for each drying chamber. Therefore, according to an embodiment, the longitudinal airflows in the several drying chambers can have different orientations. Whereas some of the drying chambers have a longitudinal airflow in the direction of transport of the sheets, others can have a longitudinal airflow in a direction opposite to the transport direction of the sheets.

The arrangement of the air supply means for introducing air and of the air discharge means for discharging air is depending on the desired direction of airflow. If the direction of a longitudinal airflow is in the direction of the transport direction of the sheets, then the air supply means are arranged upstream of the air discharge means relative to the transport direction of the sheets. If the direction of the longitudinal airflow is opposite to the direction of the transport direction of the sheets, then the air supply means are arranged downstream of the air discharge means relative to the transport direction of the sheets.

A crosswise airflow is understood to be an airflow in a direction perpendicular to the transport direction of the sheets, preferably parallel to the main surface of the sheets. A crosswise airflow can be created by arranging air supply means and the air discharge means on opposite sides of the drying chambers at a location at or close to the lateral ends of the sheets. According to another embodiment, one of air supply means and air discharge means is arranged at a location at or close to the center line of the sheets running in the longitudinal direction and the other is arranged at or close to one or both lateral sides of the sheets.

Accordingly, in the first drying stage in an embodiment with crosswise airflow, the air supply means corresponds to the first stage drying air supply means 100 for introducing hot air and the air discharging means 110 correspond to the first stage air discharge means for discharging exhaust air. In the second drying stage the air supply means correspond to the humid drying air supply means 130 and the air discharge means correspond to second stage air discharge means.

According to an embodiment, wherein the first and/or the second drying stage is formed with crosswise ventilated drying chambers, the drying stage preferably comprises more than one drying chamber. The drying conditions in each of the drying chambers can be adjusted individually. A temperature profile then can be established in a longitudinal direction of the drying stage such that the drying temperature can be adjusted corresponding to the amount of water present in the sheets, in particular gypsum boards.

According to an embodiment, the first drying stage comprises a multiplicity of crosswise ventilated drying chambers. Accordingly, the at least one drying chamber of the first drying stage is a crosswise ventilated drying chamber. According to an embodiment, all of the drying chambers of the first drying stage are crosswise ventilated drying chambers. The crosswise ventilated drying chambers are relatively short and basically have a dimension to receive the width of the conveying means and the sheets conveyed on the conveying means.

The individual crosswise ventilated drying chambers are arranged one after the other in a cross direction relative to the longitudinal transport direction of the sheets.

According to an embodiment, the drying chambers of the first drying stage can be individually heated and aerated.

In the first drying stage a temperature profile can be established by individually adjusting for each drying chamber the temperature of the drying air as well as the flow rate of the drying air.

In the beginning of the drying process the sheets, in particular gypsum plasterboards or gypsum fiber boards, have a high water load and efficient cooling of the sheets is achieved by evaporation of water. High drying rates can be achieved by using high temperature drying air and/or high flow rates.

According to an embodiment, the first drying stage comprises more than two drying chambers, according to an embodiment 1 to 4 or more than 5 drying chambers and according to a further embodiment more than 6 drying chambers. According to a further embodiment, the first drying stage comprises less than 30 drying chambers and according to a further embodiment less than 20 drying chambers.

According to a further embodiment, a pre-drying zone is provided upstream of the first drying stage. In such a pre-drying zone the freshly prepared gypsum board is heated to a temperature in a range of 50 to 100° C. before entering the first drying stage where air heated to a high temperature, i.e. above 100° C., is used for evaporating water from the wet gypsum board.

According to an embodiment, the second drying stage comprises at least one drying chamber that is ventilated in a longitudinal direction. Accordingly, the at least one drying chamber of the second drying stage is a longitudinally ventilated drying chamber.

According to an embodiment, the second drying stage comprises more than 2 longitudinally ventilated drying chambers arranged one after the other. According to an embodiment, the second drying stage comprises less than 5, according to a further embodiment less than 4 longitudinally ventilated drying chambers.

According to a further embodiment, all drying chambers of the second drying stage are longitudinally ventilated drying chambers.

According to a further embodiment, the second drying stage comprises longitudinally as well as crosswise ventilated drying chambers.

By aligning the airflow with the longitudinal axis of the drying chamber, it is possible to increase the contact time between the air and the boards, thus increasing the drying rates.

According to an embodiment, the longitudinally ventilated drying chambers of the second drying stage are individually heated and aerated. A longitudinal temperature gradient can be established.

According to an embodiment, control devices for adjusting temperature and airflow are provided.

According to the invention, a supplemental air inlet is provided in the second drying stage. Supplemental air then can be introduced into a drying chamber of the second drying stage to lower the dew point of the drying air and to adjust the temperature of the air present in the drying chamber.

The supplemental air inlet, according to an embodiment, is provided at the at least one drying chamber of the second drying stage downstream of the humid drying air inlet and the supplemental air can be introduced directly into the drying chamber. Nozzles can be provided in the drying chamber for injecting the supplemental air into the airstream circulated in the drying chamber. Referring to the longitudinal dimension of the second drying stage, the position of the supplemental air inlet is according to an embodiment selected in the second half of the second drying stage. In the upstream half of the second drying stage the sheets are dried further to remove most of the moisture still present in the sheets.

According to an embodiment, the at least one longitudinally ventilated drying chamber of the second drying stage is provided with a second stage recirculation line and the supplemental air inlet is provided at the second stage recirculation line. The second stage recirculation line is connected to the second-stage drying chamber at an upstream and a downstream end. Means for accelerating an airstream in the second stage recirculation line are provided according to an embodiment, e.g. a fan or a compressor, to build up pressure for introducing the recirculated air into at least one drying chamber of the second drying stage. According to an embodiment, a heating device, e.g. a direct heating burner system or indirectly heated systems, for example via thermal oil or by steam, is provided in the second stage recirculation line, preferably at a position downstream of the supplemental air inlet.

According to an embodiment, the second drying stage has at least two drying chambers and the supplemental air inlet is positioned in the last heating chamber in a downstream direction.

According to an embodiment, a cooling section is provided downstream of the last drying chamber of the second drying stage. In the cooling section the dried sheets are cooled to about room temperature to then be removed from the drying device.

According to a further aspect of the invention, a method for drying sheets is described. The method can be performed with the drying device as described above.

According to the invention, a method for drying sheets is provided, wherein a wet sheet is introduced into a device for drying sheets (as described above),

- the wet sheet is conveyed through a first drying stage and hot air is introduced into the at least one drying chamber to contact the wet sheet and to evaporate humidity from the wet sheet to obtain a partly dried sheet;
- exhaust air is discharged from said at least one drying chamber of the first drying stage and said exhaust air is collected from said at least one drying chamber of the first drying stage;
- the partly dried sheet is conveyed through a second drying stage which comprises at least one drying chamber;
- at least part of the exhaust air collected from said at least one drying chamber of the first drying stage is comprised in humid drying air, and said humid drying air is introduced into the at least one drying chamber of the second drying stage at an upstream position of the second drying stage;
- supplemental air is introduced into the at least one drying chamber of the second drying stage at a position downstream of the upstream position for introducing humid drying air to obtain a dried sheet; and
- the dried sheet is removed from the device for drying sheets.

According to the method of the invention, a wet sheet is dried partially in a first drying stage thereby removing part of the (surplus) water comprised in the sheet after its production. For drying, hot air is blown on the sheet and, after water-uptake from the wet sheet, exhaust air is removed from the first drying stage. The exhaust air obtained in the first drying stage is collected and is used at least in part in a second drying stage for drying the partly dried sheets received from the first drying stage.

The exhaust air collected in the first drying stage still has a high temperature and, due to the humidity level comprised, has a high heat capacity and, therefore, has a high drying capacity. Therefore, it is highly advantageous if the share of exhaust air comprised in the humid drying air in the second drying stage is selected to be high. According to an embodiment, the amount of exhaust air comprised in the humid drying air at a site where the humid drying air is introduced into the second stage drying chamber is selected larger than 10 vol. %, according to an embodiment is selected larger than 30 vol. %. According to an embodiment, the amount of exhaust gas comprised in the humid drying air is less than 50 vol. %, according to a further embodiment is less than 40 vol. % as determined for example by an anemometer or via differential pressure measurements. The amount of humid air introduced in the second stage drying chamber depends on the temperature and the moisture content desired at that drying stage. For example a temperature of less than 160° C. allows for a moisture content of less than 300 g/kg dry air, preferably of less than 200 g/kg dry air.

Further, it is advantageous to use a humid drying air of high temperature to increase the drying efficiency. The temperature of the humid drying air can be selected high as long as sufficient water is available in the sheets to allow effective cooling when the material of the sheet is temperature sensitive.

However, in particular when a longitudinal airflow is used in the second drying stage and a high water load is present in the airflow due to use of exhaust air from the first drying stage condensation of liquid water can occur towards end of the drying procedure when the sheets have to be cooled to be removed from the drying device. Further, since the amount of residual water present in the sheets is low towards the end of the drying procedure, also cooling efficiency due to water evaporation is low. Therefore, excessive heating easily happens, in particular when a high humidity level is employed in the humid drying air.

According to the invention supplemental air is added at a downstream position of the second drying stage, preferably in the last drying phase, to lower the dew point of the humid drying air-flow used in an upstream portion of the second drying stage for drying the partly dried sheets.

The addition of supplemental air therefore avoids condensation of liquid water when the temperature of the air used for drying in the second drying stage is lowered in the second drying stage towards end of the drying procedure. Further, by accordingly adjusting the temperature of the supplemental air a humid drying air-flow of high temperature can be used for drying of the partly dried sheets in an upstream portion of the second drying stage without the danger of excessively heating the sheets in a downstream portion of the second drying stage. This is of particular relevance when the method is used for drying gypsum plaster boards since calcination of calcium sulfate dihydrate has to be avoided during the drying of the gypsum plaster boards. Adhesion of the liners to the sandwiched gypsum layers is impaired in case calcium sulfate dihydrate is transformed to calcium sulfate hemihydrate or even anhydrite.

The wet sheet to be dried by the method of the invention is received from a production unit for producing sheets. The wet sheet is produced by known methods. According to an embodiment, in which the sheet is a gypsum plaster board, the gypsum plaster board is formed by known methods by application of an aqueous stucco slurry to a liner and then covering the top of the formed stucco slurry layer with another liner. The liner is made of materials known from the state of the art. Exemplary liner materials are cardboard, synthetic materials in the form of a foil or of a fabric, glass fiber fabric. Other liner materials can be used as well.

The thickness of the sheet, in particular a sandwich consisting of the liners with gypsum layers arranged in between, is adjusted by known methods. The boards can preferably be thicker than 6 mm and thinner than 60 mm, preferably thinner than 30 mm.

Basically, the sheets can have almost any size and thickness as long as the sheets can be processed in the drying device.

When using the method according to the invention for drying gypsum plaster boards such boards can have any size and thickness. Size and thickness of the gypsum plaster boards are limited by the dimensions of the drying device. Gypsum plaster boards that are dried by use of the method according to the invention usually have a thickness of more than 5 mm, according to an embodiment of more than 6 mm and according to a still further embodiment of more than 8 mm. According to a further embodiment, the gypsum plaster boards have a thickness of less than 60 mm, according to an embodiment of less than 40 mm and according to a further embodiment of less than 30 mm. However, gypsum plaster boards of larger or smaller thickness can also be dried by the method of the invention. Typical dimensions of sheets or gypsum plaster boards to be dried by the claimed invention are a width and/or a length of more than 1 m, according to an embodiment of more than 1.5 m and according to a further embodiment of less than 9 m, preferably from 1.2 to 5 m.

When entering the first stage of the drying device, the sheet, in particular the gypsum plaster board, has a free water content of more than 20 wt. %, according to another embodiment of more than 30 wt. %. According to an embodiment, the sheet, in particular the gypsum board, has a free water content of less than 40 wt. %, according to an embodiment of less than 35 wt. %.

Before entering the drying device, the sheet according to an embodiment, has a temperature of more than 20° C., according to an embodiment of more than 25° C. According to an embodiment, the sheet has a temperature of less than 50° C., according to a further embodiment of less than 45° C.

The wet sheet is dried by passing a first drying stage and a second drying stage. In the first drying stage most of the excess water comprised in the sheet is evaporated. In the second drying stage residual water still comprised in the sheet after passage of the first drying stage is removed and the sheet is cooled to room temperature, preferably before exiting the drying device.

Excess water or free water is understood to be water that is not chemically bound to a compound the sheet is made of. It can be removed from the sheet by drying at a temperature of about 100° C. by evaporation. When gypsum boards are dried by the method of the invention, excessive water is understood to be water that is not bound in the form of calcium sulfate dihydrate.

In the first and second drying stage, the sheets are contacted with drying air. The drying air flows along a surface of the sheets and absorbs water evaporated form the sheets. The airflow can be directed in a longitudinal direction relative to the longitudinal transport direction of the sheets. The longitudinal airflow can be in the transport direction of the sheets or opposite to the transport direction of the sheets.

According to another embodiment, the air flow of the drying air is in a transversal direction, relative to the longitudinal transport direction of the sheets. The transversal airflow can be introduced in the drying chamber at one lateral side of the sheet, then flow across the surface of the sheet to be discharged on the opposite lateral side, e.g. by sucking off the air laterally of the sheets. However, according to an embodiment, the transversal airflow can also be initiated by blowing the drying air onto the surface of the sheet at a position between the lateral sides of the sheets such that the drying air flows to the lateral sides of the sheets to be sucked off on both lateral sides of the sheets.

According to an embodiment, in the first and/or second drying stage, a first airflow is provided on a top side of the sheets and a second airflow is provided on a bottom side of the sheets to increase and harmonize the drying efficiency.

The drying of the sheets is performed basically at ambient pressure. To initiate the direction of the airflow, a slight pressure difference can be provided in the drying chambers such that the airflow is directed from a higher pressure level at the point of inflow of the airflow to a lower pressure level at the point of discharge of the airflow from the drying chamber. The pressure difference is provided by injecting the airflow at one site of the drying chamber and/or extracting the airflow at a site distant to the injection site of the airflow.

The velocity of the airflow within the drying chambers of first and second drying stage is adjusted according to an embodiment within a range of 2 m/s to 40 m/s, according to an embodiment within a range of 5 m/s to 30 m/s, preferably from 8 to 22 m/s.

The sheets are, according to an embodiment, continuously conveyed through the first and second drying stage. According to an embodiment, the conveying speed is selected within a range of 0.2 m/min to 8.5 m/min, according to a further embodiment within a range of 1.0 m/min to 5.0 m/min.

The wet sheet is conveyed through the first drying stage and contacted with hot air. The hot air can be introduced into at least one drying chamber to contact the wet sheet and to evaporate the humidity from the wet sheet to obtain a partly dried sheet.

According to an embodiment, a transversal airflow is preferred for the first drying stage.

The average amount of moisture comprised in the hot air used for drying in the first drying stage is adjusted according to an embodiment within a range of 200 g/kg to 800 g/kg, according to an embodiment within a range of 250 g/kg to 500 g/kg ($g_{water}/kg_{dry\ air}$).

According to a further embodiment, when entering the drying chamber of the first drying stage, the temperature of the hot air used for drying in the first drying stage is adjusted to be higher than 140° C., according to a further embodiment to be higher than 170° C.

According to a further embodiment, when entering the drying chamber, the temperature of the hot air used for drying in the first drying stage is adjusted to be lower than 280° C.; according to a further embodiment it is adjusted to be lower than 250° C. and according to a still further embodiment it is adjusted to be lower than 200° C.

According to an embodiment, the first drying stage comprises several drying sections formed by drying chambers and the sheets consecutively pass the first-stage drying chambers/sections. This allows to individually adapt the conditions used for drying in each drying chamber/section. In particular, a temperature profile can be established in a longitudinal direction, i.e. in the transport direction of the sheets.

According to an embodiment, wherein the hot air used for drying in the first drying stage is passing the sheets in a transversal or longitudinal direction, the hot air in a first drying chamber is adjusted to a temperature within a range of 120 to 300° C., according to a further embodiment within a range of 160 to 270° C.

For example, the temperature of the hot air used for drying in the first drying stage is increased stepwise from drying chamber/section to drying chamber/section in the transport direction of the sheets until a maximum temperature is reached.

The maximum temperature, according to an embodiment, is selected to be less than 300° C., according to a further embodiment is selected to be less than 220° C. According to a further embodiment, the maximum temperature is selected to be at least 110° C.

The temperature increase when advancing from one drying chamber/section to the next drying chamber/section is according to an embodiment less than 30° C., according to a further embodiment less than 20° C. and according to a further embodiment less than 10° C. According to a further embodiment, the temperature increase when advancing from one drying chamber/section to the next drying chamber/section until a maximum temperature is reached is at least 2° C., according to a further embodiment at least 4° C.

According to a further embodiment, the temperature of the hot air used for drying in the first drying stage is increased for at least 10° C. from a first of the first-stage drying chambers to a second of the first-stage drying chambers.

After the maximum temperature has been reached, the temperature of the hot air is stepwise lowered when advancing from one drying chamber/section to the next drying chamber/section according to a further embodiment. Towards end of the first drying stage, the amount of residual water comprised in the sheet becomes lower and the cooling effect caused by evaporation of water is lowered. According to an embodiment, the temperature is lowered by 1 to 20° C. when advancing from one drying chamber/section to the next drying chamber/section.

The temperature increase or decrease when advancing from one drying chamber/section to the next drying chamber/section is adjusted according to the amount of moisture present in the sheet and the cooling effect achieved by evaporation of water. The temperature increase or decrease is adjusted thus that the temperature of the sheet, in particular close to the surface of the sheet, in particular the temperature at the surface of the sheet does not exceed a threshold value to avoid deterioration of the sheet while drying.

According to an embodiment, the temperature of the hot air used for drying in the first drying stage is adjusted so that the temperature of the sheet is below 110° C., according to an embodiment, below 105° C. The temperature of the sheet is measured at the surface of the sheet.

According to a further embodiment, the temperature of the hot air used for drying in the first drying stage is adjusted such that the core temperature of the sheet is 100° C. or lower. According to an embodiment, the core temperature of the sheet is at least 90° C., according to an embodiment is at least 95° C. An efficient and homogeneous drying of the sheet is achieved within these boundaries.

To exploit the drying capacity of the drying air efficiently, according to an embodiment, at least part of the hot air used for drying in the first drying stage is recirculated after discharge from the first-stage drying chamber. The discharged exhaust air is re-entered into the drying chamber to take up further water.

According to a further embodiment, the recirculated drying air is heated before re-entering the drying chamber.

For discharge of moisture from the first drying stage, according to an embodiment, a share of the hot air used for drying in the first drying stage is discharged as exhaust air from the first drying stage after the passage of a drying chamber.

The amount of hot air used for drying and discharged from the first drying stage after the passage of the drying chamber as exhaust air is adjusted depending on the capacity of the dryer, the amount of hot air passing the first-stage drying chamber, the temperature of the hot air, the amount of water comprised in the sheets and in the hot air and other process parameters. According to an embodiment, the amount of exhaust air discharged from the first drying stage after passage of the hot air through the at least one drying chamber is selected to be at least 10 vol. % of the air discharged from the drying chambers, according to a further embodiment at least 20 vol. % of the air discharged from the drying chambers and according to a still further embodiment is less than 50 vol. % of the air discharged from the drying chambers as determined for example by an anemometer or via differential pressure measurements.

The exhaust air discharged from the first drying stage after passage of the at least one first-stage drying chamber, according to an embodiment, has a temperature in the range of 120 to 220° C., according to a further embodiment has a temperature within a range of 140 to 180° C.

The exhaust air discharged from the first drying stage contains moisture absorbed during the passage of the hot air through the at least one first-stage drying chamber. According to an embodiment, the amount of water comprised in the exhaust air discharged from the first drying stage is adjusted within the range of 200 g/kg to 800 g/kg, according to an embodiment within a range of 250 g/kg to 500 g/kg ($g_{water}/kg_{dry\ air}$).

According to an embodiment, the exhaust air discharged from the drying chambers of the first drying stage is collected and joined to a joint flow of first-stage exhaust air. The joint flow of exhaust air is then split into a part that is recirculated to the first-stage drying chamber(s) and a part that is discharged from the first drying stage as exhaust air and can be used in the second stage as humid drying air or be disposed of.

After passage of the first drying stage partly dried sheets are obtained. The sheets, in particular gypsum boards, according to an embodiment, comprise water in an amounts of 10 to 30 wt. %, according to a further embodiment in amounts of 15 to 25 wt. % with reference to the weight of the wet board.

According to the method of the invention, the partly dried sheets, after having passed the first drying stage, enter a second drying stage for additional drying of the partly dried sheets and optionally for cooling.

For optimization of energy efficiency and drying efficiency, at least part of the exhaust air collected from said at least one drying chamber of the first drying stage is comprised in the humid drying air introduced into the at least one drying chamber of the second drying stage at an upstream position of the second drying stage.

The exhaust air collected from the first drying stage is used in the humid drying air in the second drying stage. The humid drying air can be formed exclusively by the exhaust air introduced from the first drying stage or by mixing the exhaust air from the first drying stage with drying air obtained from other sources. Such sources can be e.g. air recirculated in the second drying stage or heated fresh air or air from other sources, e.g. air obtained from other processes.

The exhaust air received from the first drying stage and comprised in the humid drying air is entered at an upstream position of the second drying stage. An upstream position is understood to be a position closer to the place of entry of the partly dried sheets into the second drying stage.

In an embodiment, wherein the second drying stage comprises more than one drying chamber the exhaust air/humid air of the first drying stage can be introduced in a drying chamber of an upstream position of the second drying stage. An upstream position is understood not to be the last drying chamber of the second drying stage when seen in a longitudinal direction of transportation of the sheets. According to an embodiment, an upstream position can be the first drying chamber of the at least two drying chambers of the second drying stage, when seen in a longitudinal transport direction of the sheets.

The exhaust air can be introduced into the at least one drying chamber of the second drying stage directly, e.g. by allowing an airflow between the last drying chamber of the first drying stage and the first drying chamber of the second drying stage or by introducing the exhaust air of the first drying stage directly into the drying chamber, e.g. via a nozzle. According to another embodiment, the exhaust air of the first drying stage can be introduced into the second drying stage indirectly, e.g. by addition of the exhaust air to a drying air recirculated in the second drying stage via a second-stage recirculation line.

In an embodiment, wherein the exhaust air from the first drying stage enters the second drying stage by mixing with recirculated air to obtain humid drying air, the humid drying air enters the second-stage drying chamber according to an embodiment at one end of the drying chamber, and after passage of the drying chamber and uptake of water from the partly dried sheets, the humid drying air is discharged at an opposite end of the second-stage drying chamber.

The temperature of the humid drying air, when entering the at least one drying chamber of the second drying stage at an upstream position is according to an embodiment adjusted within a range of 120 to 180° C., according to another embodiment within a range of 130 to 160° C.

The temperature of the humid drying air can be adjusted by suitable measures. In an embodiment wherein the temperature has to be increased the humid drying air is heated, e.g. by a heater. For lowering the temperature, fresh air can be added or heat can be extracted by passage of an heat exchanger.

According to an embodiment, the humid drying air, before entering the second-stage drying chamber, comprises moisture in an amount within a range of 200 g/kg to 800 g/kg, according to an embodiment within a range of 250 g/kg to 500 g/kg ($g_{water}/kg_{dry\ air}$).

According to the method of the invention, supplemental air is introduced into the at least one drying chamber of the second drying stage at a position downstream of the upstream position for introducing humid drying air to adjust the dew point and the temperature of the humid drying air.

In the method according to the invention, supplemental air is introduced at a downstream position of the second drying stage. By addition of supplemental air, the dew point of the humid drying air is lowered. It therefore is possible to use in an upstream part of the second drying stage a humid drying air for drying having a high water load. A humid drying air having a high water load has a high heat capacity and, therefore, can efficiently be used for drying the sheets.

Further, the humid drying air used for drying the sheets in an upstream section of the second drying stage can have a high temperature to increase drying efficiency.

According to an embodiment the temperature of the supplemental air is selected lower than the temperature of the humid drying air at the place of the supplemental air inlet, i.e. at a position where the supplemental air is injected to the humid drying air. The temperature of the supplemental air is adjusted according to an embodiment within a range of 80 to 180° C., according to an embodiment within a range of 100 to 140° C.

According to a further embodiment, the supplemental air is first mixed with recirculated air and is then heated to a desired temperature by passing a heating device, e.g. a burner. The temperature of the air after passage of the heating device is adjusted according to an embodiment within a range of 80 to 180° C., according to a further embodiment within a range of 100 to 140° C.

The amount of moisture comprised in the supplemental air is selected lower than the amount of moisture comprised in the humid drying air at the place of the supplemental air inlet, i.e. at a position where the supplemental air is injected to the humid drying air. The amount of moisture comprised in the supplemental air is selected according to an embodiment within a range of 10 to 100 $g_{water}/kg_{air}$, according to a further embodiment within a range of 20 to 80 $g_{water}/kg_{air}$.

After drying in the second drying stage the sheets optionally are cooled and then leave the drying device.

A cooling section is provided according to an embodiment for cooling the sheets after drying. According to an embodiment, the temperature in the cooling section is adjusted within a range of 10 to 80° C., according to a further embodiment to a temperature of 20 to 60° C., to then be removed from the drying device. Cooling can be achieved by blowing cool air onto the dried sheets in the cooling section.

BRIEF DESCRIPTION OF THE DRAWINGS

The invention will be explained in more detail with reference to the accompanying drawings. The figures of the drawings show.

DESCRIPTION OF THE INVENTION

Figure 1:
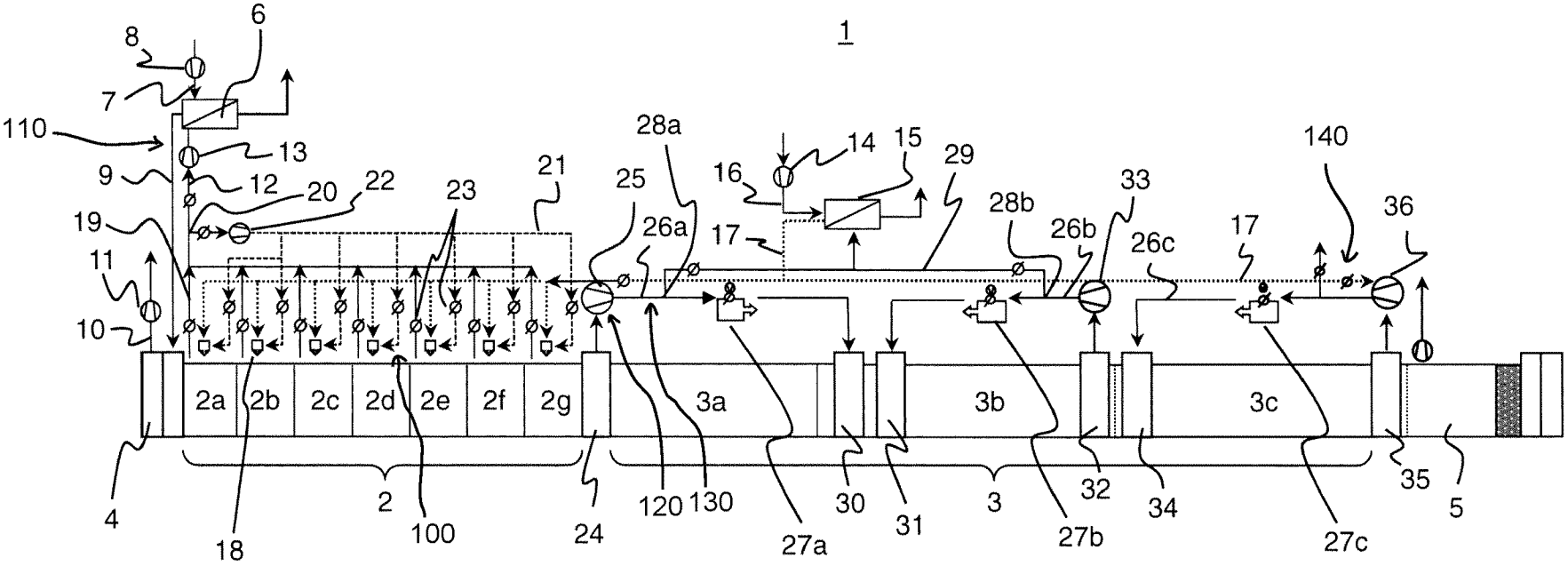
FIG. 1: a scheme of a device for drying sheets according to the invention

FIG. 1 displays a scheme of a drying device 1 according to the invention. The drying device comprises a first drying stage 2 and a second drying stage 3. Upstream of the first drying stage 2 is arranged a pre-heating zone 4 and downstream of the second drying stage 3 is arranged a cooling zone 5.

A first heat-exchanger 6 is provided for heating fresh air. A first fresh-air pipe 7 is connected to the heating part of the first heat-exchanger 6 and fresh air is aspired by a first fan 8. After passage of heat exchanger 6 the fresh air has been heated to obtain pre-heating air having a temperature adjusted preferably within a range of 80 to 150° C. The pre-heating air is introduced into the pre-heating zone 4 via a pre-heating-air pipe 9. After passage of the pre-heating zone 4 the pre-heating air is discharged via pre-heating air discharge pipe 10 equipped with second fan 11 for aspiring pre-heating air form pre-heating zone 4.

For heating of the fresh air aspired through first fresh-air pipe 7, heat ex-changer 6 is connected with its cooling part to the exhaust line of the first drying stage 2.

For heating of the fresh air in heat exchanger 6, exhaust air produced in the first drying stage, having a high humidity content as well as a high temperature, is introduced into heat exchanger 6 via a humid hot exhaust air pipe 12. In humid hot exhaust air pipe 12 is provided a third fan for pressing humid hot exhaust air received from the first drying stage 2 into heat exchanger 6. The humid hot exhaust air received from the first drying stage passes heat exchanger 6 counter-currently to the fresh air introduced through fresh-air pipe 7. Due to the low temperature of the fresh air as well as of the pre-heating air, the humid hot exhaust air received from the first drying stage is cooled below the dew point of the humid hot exhaust air and therefore also heat of condensation can be used to warm up the fresh air to be used as pre-heating air in pre-heating zone 4.

The sheets, in particular gypsum boards, are introduced into heating device 1 through pre-heating zone 4. The sheets are heated to a core temperature of about 40 to 80° C. before entering the first drying stage 2.

The first drying stage 2 comprises seven drying chambers **2*a*-2*g* which are transversally aerated. Hot air inlets and discharge means for discharging exhaust air (not shown) are arranged at opposite ends of the transversally aerated drying chambers 2*a*-2*g*** to induce a transversal airflow.

Fresh air is aspired by a forth fan 14 from the surroundings and is introduced into second heat exchanger 15 via second fresh-air pipe 16.

After passage of second heat-exchanger 15 the fresh air is warmed up to a temperature of preferably 80 to 140° C. and the warmed fresh air is introduced into warmed fresh air pipe 17.

Each drying chamber 2*a*-2*g* is equipped with a burner 18 connected to warmed fresh air pipe 17. The warmed fresh air is mixed with fuel, e.g. natural gas, and by burning the warmed fresh air is further heated. The hot air obtained from burner 18 then is introduced into drying chambers 2*a* to 2*g* of the first drying stage 2 via hot air inlets (not shown).

After passage of the drying chambers 2*a* to 2*g* the hot air has absorbed water from sheets conveyed through the first drying stage 2 of the drying device 1 and is discharged as exhaust air through first stage exhaust pipe 19. Each first stage drying chamber 2*a* to 2*g* is equipped with an individual first stage exhaust pipe 19*a* to 19*g* which are joined to a joint exhaust pipe 19.

At a splitter 20 provided in exhaust pipe 19, the flow of exhaust air is divided into a part guided through first exhaust pipe 12 to first heat exchanger 6 for recovery of heat comprised in the exhaust air, and a part to be recirculated. The share of the exhaust air guided into first exhaust pipe 12 and the share of the exhaust air to be recirculated can be adjusted. According to an embodiment, about 20 to 50 vol. % of the exhaust air is guided to first exhaust air pipe 12 and the remainder of the exhaust air is recirculated.

A first stage recirculation pipe 21 is connected to the splitter and a fifth fan 22 is provided in recirculation pipe 21 for pressing recirculated exhaust air through first stage recirculation pipe 21. First stage recirculation pipe 21 comprises individual connecting pipes 21*a* to 21*g* connected to burners 18*a* to 18*g* for introducing the recirculated exhaust gas into burners 18*a* to 18*g*. The recirculated exhaust air is mixed with the warmed fresh air introduced into burner 18*a* to 18*g* via warmed fresh air pipe 17. The recirculated exhaust gas is burnt together with warmed fresh air and fuel to provide hot air for introduction into drying chambers 2*a* to 2*g* of the first drying stage 2.

The airflow within the first drying stage can be adjusted by valves 23.

The last drying chamber 2*g* arranged at a downstream end of the first drying stage 2 is connected to a port 24 of the first drying chamber 3*a* of the second drying stage 3. In port 24 a sheet, after having passed the first drying stage 2, is introduced into second drying stage 3.

The second drying stage 3 comprises three second-stage drying chambers 3*a* to 3*c* consecutively arranged in a longitudinal direction. The second-stage drying chambers 3*a* to 3*c* are aerated longitudinally.

A sixth fan 25 is connected to port 24, the fan aspirating air from the last downstream drying chamber 2*g* of the first drying stage and from the first drying chamber 3*a* of the second drying stage via port 24. Exhaust air from the last drying chamber 2*g* of the first drying stage and humid drying air from the first drying chamber 3*a* of the second drying stage are mixed and after passage of the sixth fan 25 are guided through humid drying air recirculation pipe 26*a*. In humid drying air recirculation pipe 26*a* is provided a second-stage burner 27*a* for heating the humid drying air by burning fuel introduced into the flow of humid drying air.

A humid drying air airflow splitter 28*a* is provided in humid drying air recirculation pipe 26*a* upstream of second stage burner 27*a*. Humid exhaust air is deviated from the airflow of humid drying air recirculated in humid drying air recirculation pipe 26*a* at humid drying air airflow splitter 28*a* and is guided through humid exhaust air pipe 29*a* to second heat exchanger 15. Since the fresh air introduced into second heat exchanger 15 via second fresh-air pipe 16 has a low temperature below the dew point of the humid exhaust air also heat of condensation can be used when transferring heat from the humid exhaust air to the fresh air that flows counter-currently in the second heat exchanger 15. After passage of the second heat exchanger 15 the humid drying air is cooled and can be discharged to the surroundings.

After passage of the second stage burner 27*a* for heating the humid drying air the hot humid drying air is introduced at a humid drying air inlet (not shown) provided at downstream port 30. The hot humid drying air enters the first second-stage drying chamber 3*a* counter-currently to the conveying direction of sheets.

Downstream of the first second stage drying chamber 3*a* is arranged a further (second) second-stage drying chamber 3*b* provided with an entry port 31 and an exit port 32. The second second-stage drying chamber 3*b* is aerated longitudinally wherein the direction of flow of the humid drying air is in the same direction as the transport direction of the sheets.

Similarly to the first second-stage drying chamber 3*a*, the second second-stage drying chamber is equipped with a seventh fan 33 and a humid drying air recirculation pipe 26*b*. At a second airflow splitter 28*b* provided in the humid drying air recirculation pipe 26*b* the flow of recirculated humid drying air is split in a part that is guided to second heat exchanger 15 via humid exhaust air pipe 29 and a recirculated part that is guided to burner 27*b* to be heated.

Humid drying air inflow means (not shown) are provided in entry port 31 and humid drying air heated at burner 27*b* can be introduced at entry port 31 to then enter second second-stage drying chamber 3*b*.

Downstream of exit port 32 is provided a third second-stage drying chamber 3*c*. The third second-stage drying chamber is provided with an entry port 34 and an exit port 35 similar to first and second second-stage drying chambers.

A humid drying air recirculation pipe 26*c* is provided equipped with an eighth fan 36 and a second stage burner 27*c* for heating recirculated humid drying air. Humid drying air is discharged from the third second-stage drying chamber 3*c* at exit port 35 and then is driven by eighth fan 36 towards second-stage burner 27*c* and then reenters third second stage drying chamber 3*c*.

According to the invention, supplemental air is introduced in the last second-stage drying chamber 3*c* to lower dew point and temperature of the humid drying air used in the last second-stage drying chamber 3*c* for drying the sheets.

The supplemental air is supplied in warmed fresh air pipe 17 which is connected to eighth fan 36. Warmed fresh air provided in warmed fresh air pipe 17 is mixed as supplemental air with humid drying air aspired from exit port 35. After mixing the air is forwarded to burner 27*c* to be heated and then enters third second stage drying chamber 3*c* at entry port 34.

In the following drying of a sheet will be described with reference to the drying of gypsum plasterboards.

A wet gypsum plasterboard is conveyed through drying device 1 by conveying means (not shown). The conveying means convey the gypsum plaster sheets at a speed of for example 65 m/min.

The wet gypsum plasterboards enter drying device 1 by entering pre-drying zone 4 at an upstream end. Exemplary wet gypsum plasterboards used for explaining the drying process have an edge length of 1200 mm and a thickness of 12.5 mm. The wet weight of the gypsum plasterboards before entering the drying device is about 8 to 13 kg/m$^2$.

In the pre-drying zone 4 the wet gypsum plasterboard is warmed up to about 40 to 60° C. by contacting the wet gypsum plasterboard with pre-heated air introduced through pre-heating-air pipe 9. The pre-heated air has a temperature of about 100 to 140° C.

The pre-heated gypsum plasterboard then enters the first drying stage 2. The first drying stage 2 comprises seven first stage drying chambers 2*a* to 2*g* which are aerated in a direction transverse to the transport direction of the gypsum plasterboards.

The temperature and the flow of the hot drying air in each of the first stage drying chambers can be adjusted individually by adjusting the amount of fuel burnt in burners 18 and adjustment of valves regulating the amount of hot drying air introduced into first-stage drying chambers 2*a*-2*g*.

The temperature of the hot drying air entering the first stage drying chambers 2*a*-2*g* and of exhaust air leaving the same are summarized in table 1:

TABLE 1 temperature of hot drying air used in first stage drying chambers, for example:

| Drying chamber | 2a | 2b | 2c | 2d | 2e | 2f | 2g |
|---|---|---|---|---|---|---|---|
| $T_{in}$ (° C.) | 176 | 208 | 218 | 225 | 240 | 249 | 242 |
| $T_{out}$ (° C.) | 145 | 163 | 177 | 189 | 190 | 195 | 200 |

Figure 2:
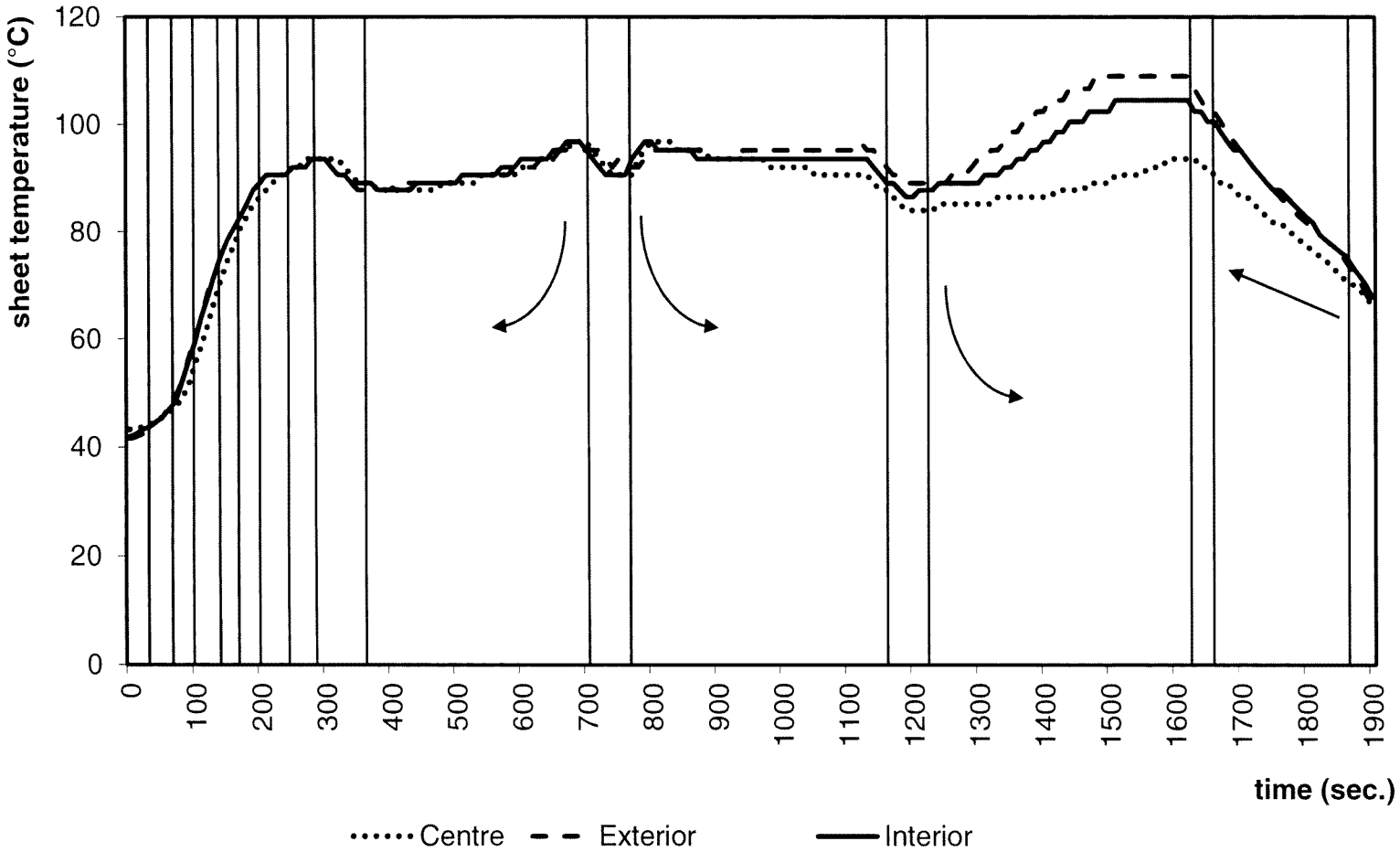
FIG. 2: a diagram showing the temperature of sheets while passing the device for drying sheets according to the invention

The temperature of the gypsum plasterboard while travelling through the first stage drying chambers is displayed in FIG. 2. The temperature of the gypsum plaster sheet in the center of the sheet slowly increases to reach a maximum of about 90° C. Due to the high rate of water evaporation from the wet gypsum plaster sheets, the temperature of the gypsum plaster sheet at its center and its surface remains at a low level of about 90° C. The temperature at the center of the gypsum plasterboard is about the same as at its surface. No excessive heating can be observed.

After passage of the first drying stage 2 the partly dried gypsum plasterboard has a moisture content of about 10 to 20 wt. %.

The partly dried gypsum plasterboard then enters the second drying stage 2 comprising three second-stage drying chambers 3*a* to 3*c* that are longitudinally aerated.

The temperature of the humid drying air introduced into and discharged from second stage drying chambers 3*a* to 3*c* is summarized in table 2:

TABLE 2

Example of temperature of humid drying air used in second stage drying chambers

| Drying chamber | 3a | 3b | 3c |
|---|---|---|---|
| $T_{in}$ (° C.) | 252 | 250 | 160 |
| $T_{out}$ (° C.) | 164 | 168 | 135 |

In the first drying chamber 3*a* of the second drying stage the humid drying air is adjusted to a high temperature of 252° C. and enters drying chamber 3*a* at a downstream end to flow counter-currently to the conveying direction of the gypsum plaster sheets. Exhaust air received from the last drying chamber 2*g* of the first drying stage 2 and humid drying air discharged from first second-stage drying chamber 3*a* are aspired by fan 25, mixed and heated in second-stage burner 27*a* to obtain humid drying air to be is used for drying the gypsum plaster sheets. The exhaust air discharged from drying chamber 2*g* has a temperature of 150 to 240° C. and a water load of 200 to 800 $g_{water}/kg_{air}$. The exhaust air is mixed with humid drying air discharged from drying chamber 3*a*. After heating in burner 27*a*, the humid drying air introduced into the first second-stage drying chamber 3*a* has a temperature of 140 to 280° C. and a water load of 150 to 600 $g_{water}/kg_{air}$.

As can be seen from FIG. 2, the core temperature and the surface temperature of the gypsum plaster sheets while passing the first second-stage drying chamber 3*a* ("Zone I") remains on about the same level of about 90° C., slightly increasing. The temperature in the core of the gypsum plaster sheets and at the surface of the gypsum plasterboards is about the same.

After passage of the first second-stage drying chamber 3*a* the gypsum plasterboards have a moisture content of about 10 wt. %.

The gypsum plasterboards then enter second second-stage drying chamber 3*b*. Humid drying air enters the second second-stage drying chamber 3*b* at port 31. The humid drying air has a temperature of 140 to 200° C. and humidity of 150 to 500 $g_{water}/kg_{air}$. As can be seen from FIG. 2, the core and surface temperature of the gypsum plasterboards while passing the second second-stage drying chamber 3*b* ("Zone II") remains at a level of about 90° C. The temperature at the center of the boards is about the same as at the surface of the boards.

After passage of the second second-stage drying chamber 3*b*, the gypsum plasterboards have a moisture content of about 10 to 20 wt. %, preferably of about 5 to 15 wt. %.

The boards then enter the third second-stage drying chamber 3*c* at port 34. Humid drying air is introduced at port 34 to flow in a downstream direction relative to the transport direction of the boards.

The humid drying air introduced in third second-stage drying chamber 3*c* at port 34 has a temperature of 90 to 170° C. and a moisture content of 90 to 250 $g_{water}/kg_{air}$. The humid drying air is formed by mixing exhaust air discharged from third second-stage drying chamber 3*c* at port 35, having a temperature of 90 to 150° C. and a humidity of 90 to 200 $g_{water}/kg_{air}$ with warmed fresh air having a temperature of 80 to 160° C. and a humidity of 10 to 80 $g_{water}/kg_{air}$. The mixed air is then heated in burner 27*c*.

As can be seen from FIG. 2, "Zone 3", The temperature in the center of the gypsum plasterboard is lower than at the outer surface of the board. However, also at the outer surface of the board, the temperature remains below 120° C. and, therefore, no re-calcination of the calcium sulfate dihydrate occurs at the outside regions of the gypsum plasterboard.

1 drying device
2 first drying stage
3 second drying stage
4 pre-heating zone
5 cooling zone
6 first heat-exchanger
7 first fresh-air pipe
8 first fan
9 pre-heating-air pipe
10 pre-heating air discharge pipe
11 second fan
12 first exhaust pipe
13 third fan
14 forth fan
15 second heat exchanger
16 second fresh-air pipe
17 warmed fresh air pipe
18 burner
19 first stage exhaust pipe
20 splitter
21 first stage recirculation pipe
22 fifth fan

23 valve
24 port
25 sixth fan
26 humid drying air recirculation pipe
27 second stage burner
28 humid drying air airflow splitter
29 humid exhaust air pipe
30 downstream port
31 entry port
32 exit port
33 seventh fan
34 entry port
35 exit port
36 eighth fan

The invention claimed is:

1. A device for drying sheets, comprising:

a conveying device for conveying sheets through the device for drying sheets, a first drying stage arranged towards an upstream end of the device for drying sheets and comprising at least one drying chamber, a first stage drying air supply for introducing hot air into said at least one drying chamber of said first drying stage with at least one drying air inlet;

an air discharge for discharging exhaust air from said at least one drying chamber of said first drying stage, a second drying stage arranged downstream of the first drying stage and comprising a plurality of drying chambers;

an air transfer device for transferring exhaust air discharged from said at least one drying chamber of the first drying stage into at least one drying chamber of the second drying stage;

a humid drying air supply for introducing humid drying air comprising said exhaust air into said at least one drying chamber of said second drying stage; and a supplemental air supply for introducing supplemental air into at least the most downstream drying chamber of said second drying stage, wherein the supplemental air contains less water than the humid drying air, and only humid drying air is introduced into the most upstream drying chamber of the second drying stage.

2. The device according to claim 1, wherein the at least one drying chamber of the first drying stage is a crosswise ventilated drying chamber.

3. The device according to claim 1, wherein at least one drying chamber of the second drying stage is a longitudinally ventilated drying chamber.

4. The device according to claim 1, wherein said supplemental air inlet is arranged at a position downstream of at least 30% of the total length of said second drying stage.

5. The device according to claim 1, wherein the supplemental air introduced into at least the most downstream drying chamber mixes with humid drying air introduced into at least the most downstream drying chamber.

6. A method for drying sheets, wherein a wet sheet is introduced into a device for drying sheets, comprising the steps of;

conveying the wet sheet through a first drying stage and introducing hot air is introduced into the at least one drying chamber to contact the wet sheet and to evaporate humidity from the wet sheet to obtain a partly dried sheet;

discharging exhaust air from said at least one drying chamber of the first drying stage and collecting said exhaust air from said at least one drying chamber of the first drying stage;

conveying the partly dried sheet through a second drying stage comprising a plurality of drying chambers;

introducing humid drying air comprising at least part of the exhaust air collected from said at least one drying chamber of the first drying stage into at least one drying chamber of the second drying stage;

introducing supplemental air into at least the most downstream drying chamber of the second drying stage to obtain a dried sheet; and removing the dried sheet from the device for drying sheets, wherein the supplemental air contains less water than the humid drying air, and only humid drying air is introduced into the most upstream drying chamber of the second drying stage.

7. The method according to claim 6, wherein the hot air introduced into the at least one drying chamber of the first drying stage passes the sheet in a direction transverse to a longitudinal transport direction of the sheet through said first drying stage.

8. The method according to claim 6, wherein the humid drying air introduced into the second drying stage passes the sheet in a direction parallel to the longitudinal transport direction of the sheet through said second drying stage, and wherein the direction is the same or opposite relative to the transport direction of the sheets.

9. The method according to claim 6, wherein the device for drying sheets comprises:

a conveying device for conveying sheets through the device for drying sheets, a first drying stage arranged towards an upstream end of the device for drying sheets and comprising at least one drying chamber, a first stage drying air supply for introducing hot air into said at least one drying chamber of said first drying stage with at least one drying air inlet;

an air discharge for discharging exhaust air from said at least one drying chamber of said first drying stage, a second drying stage arranged downstream of the first drying stage and comprising a plurality of drying chambers;

an air transfer device for transferring exhaust air discharged from said at least one drying chamber of the first drying stage into at least one drying chamber of the second drying stage;

a humid drying air supply for introducing humid drying air comprising said exhaust air into said at least one drying chamber of said second drying stage; and a supplemental air supply for introducing supplemental air into at least the most downstream drying chamber of said second drying stage via at least one supplemental air inlet.

10. The method of claim 6, wherein the humid drying air has a moisture amount in a range of 150 $g_{water}/kg_{air}$ to 600 $g_{water}/kg_{air}$, and the supplemental air has a moisture amount in a range of 10 $g_{water}/kg_{air}$ to 100 $g_{water}/kg_{air}$.

11. The method of claim 6, wherein the supplemental air introduced into at least the most downstream drying chamber mixes with humid drying air introduced into at least the most downstream drying chamber.

* * * * *